US006358023B1

(12) United States Patent
Guilmette

(10) Patent No.: US 6,358,023 B1
(45) Date of Patent: Mar. 19, 2002

(54) MOMENT PUMP

(76) Inventor: Paul Guilmette, P.O. Box 13, Canton Center, CT (US) 06020

( * ) Notice: Subject to any disclaimer, the term of this patent is extended or adjusted under 35 U.S.C. 154(b) by 0 days.

(21) Appl. No.: 09/643,924

(22) Filed: Aug. 23, 2000

(51) Int. Cl.[7] ..... F04B 19/02; F04B 27/06
(52) U.S. Cl. ..... 417/460; 417/257
(58) Field of Search ..... 417/460, 474, 417/388, 257, 393, 273, 395, 383; 141/1

(56) References Cited

U.S. PATENT DOCUMENTS

| | | | | | |
|---|---|---|---|---|---|
| 238,639 | A | | 3/1881 | Boerner | |
| 3,118,596 | A | | 1/1964 | Saile | 230/160 |
| 3,618,390 | A | | 11/1971 | Frick | 73/398 |
| 3,656,873 | A | * | 4/1972 | Schiff | 417/395 |
| 3,999,896 | A | * | 12/1976 | Sebastiani | 417/383 |
| 4,012,178 | A | | 3/1977 | Puckett | 417/478 |
| 4,274,452 | A | * | 6/1981 | Schmitt | 141/1 |
| 4,373,867 | A | | 2/1983 | Campbell | 417/90 |
| 4,439,112 | A | * | 3/1984 | Kitsnik | 417/383 |
| 4,462,767 | A | * | 7/1984 | Dorsch | 417/460 |
| 4,479,762 | A | * | 10/1984 | Bilstad et al. | 417/395 |
| 4,523,903 | A | | 6/1985 | Arens | 417/489 |
| 4,540,346 | A | * | 9/1985 | Davies | 417/273 |
| 4,555,222 | A | * | 11/1985 | Casilli | 417/393 |
| 4,750,868 | A | * | 6/1988 | Lundback | 417/257 |
| 5,106,274 | A | * | 4/1992 | Holtzapple | 417/388 |
| 5,273,406 | A | * | 12/1993 | Feyginj | 417/474 |
| 5,381,675 | A | | 1/1995 | Siegel | 62/498 |
| 5,564,143 | A | | 10/1996 | Pekar et al. | 5/708 |

FOREIGN PATENT DOCUMENTS

DE 2 344 530 3/1974

* cited by examiner

*Primary Examiner*—Teresa Walberg
*Assistant Examiner*—Leonid M Fastovsky
(74) *Attorney, Agent, or Firm*—Libert & Associates

(57) ABSTRACT

The moment pump (10) of the present invention includes a flexible container (12) having an outer wall (14) and two opposing end walls (16, 18) attached thereto. The container (12) is made of a resilient material and has a preformed, non-biased shape. A pair of one-way valves (20) is operably attached to the container (12) and provides for the flow of a liquid therethrough. A first actuator rod (22) has fixedly attached on one end a first biasing object (24) and on the other end a restraining member (26). The first end wall (16) is attached to the first actuator rod (22) between the first biasing object (24) and the restraining member (26). A second actuator rod (30) has fixedly attached on one end a second biasing object (28) and on the other end a transfer housing (32). The second actuator (30) slidably passes through the second end wall (41). The transfer housing (32) has an interior chamber (34) into which the longitudinal restraining member (26) of the first actuator travels in confinement, not being able to leave the interior chamber (34). The interior chamber (34) prevents the longitudinal restraining member (26) from being removed therefrom. The transfer housing (32) is cylindrically shaped about the interior chamber (34) and has open end (39) into which the first actuator enters (22). Attached between the exterior wall (36) of the transfer housing (32) and the inner surface (38) of the outer wall (14)of the container (12) is a plurality of biasing tension actuators (40) divided into two sets of tension actuators, a clockwise set and a counterclockwise set. Movement of the transfer housing (32) by the second actuator rod (30) or movement of the container (12) by the first actuator rod (22) causes the outer wall of the container to be pulled in a direction to the transfer housing (32) thus decreasing the volume therein. This acts as the pump action. Upon release of the biasing force, the outer wall of the container (12) returns to its resilient shape and this action draws in fluid into the container (12).

2 Claims, 3 Drawing Sheets

MOMENT PUMP

BACKGROUND OF THE INVENTION

1. Field of the Invention

The present invention relates to fluid pumps and, in particular, to pumps that pump fluids when acted upon by external forces of a cyclic or non-cyclic nature.

2. Related Art

Numerous fluid pumps are driven by an external cyclic driving force that forces the diaphragms or flexible chambers to deflate/inflate, in a repetitive manner, in order to pump fluids therethrough having one-way valves attached to chambers to insure one-way flow. The cyclic forces are provided by electric motors and/or a fluid pressure source. Examples of these types of pumps are shown in U.S. Pat. No. 238,639, issued to Boerner on Mar. 8, 1881 and entitled "Air Pump"; U.S. Pat. No. 4,012,178, issued to Puckett on Mar. 15, 1977 and entitled "Hydraulic Pump With Replaceable Pumping Member"; U.S. Pat. No. 4,373,867, issued to Campbell on Feb. 15, 1983 and entitled "Pressure Charged Airlift Pump"; U.S. Pat. No. 4,523,903, issued to Arens on Jun. 18, 1985 and entitled "Dosing Pump"; and U.S. Pat. No. 5,381,675, issued to Siegel on Jan. 17, 1995 and entitled "Force-Sparing Balanced Bellows Refrigeration Device".

Other types of fluid pumps pump only upon a demand such, as provided by a human user. Examples of these types of pumps are shown in U.S. Pat. No. 3,118,596, issued to Saile on Jan. 21, 1964 and entitled "Pumps" and U.S. Pat. No. 5,564,143, issued to Pekar et al on Oct. 15, 1996 and entitled "Check Valve for Fluid Bladders".

SUMMARY OF THE INVENTION

The moment pump of the present invention is dimensioned and configured so that an external biasing force will cause the moment pump to pump a fluid. The moment pump comprises a flexible container having an outer wall, a first end wall and an opposite end wall, the walls cooperating to form an interior chamber of the flexible container. The interior chamber has a transfer housing positioned within the interior chamber and the transfer housing has an outer wall which has a first end wall with an aperture therein and an opposite end wall. The transfer housing walls cooperate to form an interior restraining member chamber. A first actuator rod is dimensioned and configured for connection to a first biasing object at one end thereof when in operation, being fixedly connected to the first end wall of the container, and having a longitudinal restraining member on the other end which is positioned within the interior restraining member chamber. A second actuator rod is dimensioned and configured for connection to a second biasing object at one end thereof when in operation. The second actuator rod is slidably connected to the opposite end wall of the container, and is fixedly connected to the opposite end wall of the transfer housing. A plurality of biasing tension actuators are connected to the transfer housing and the outer wall of the flexible container whereby a biasing force applied to the actuator rods, either singly or together, causes the outer wall of the flexible container to contract in the direction of the transfer housing, whereby the interior chamber's volume decreases. Upon release of the biasing force, the outer wall of the flexible container returns to its unbiased shaped. In order to pump fluid, an input fluid connector is attached to the flexible container and has a one-way valve operably connected thereto. An output fluid connector is attached to the flexible container and has a one-way valve operably connected thereto, whereby the application and release of the biasing force causes the flexible container to pump fluid therethrough.

Therefore, the present invention provides a moment pump that operates by means of a nature force and need not be cyclic in nature.

These and many other objects and advantages of the present invention will be readily apparent to one skilled in the pertinent art from the following detailed description of a preferred embodiment of the invention and related drawings.

DETAILED DESCRIPTION OF THE INVENTION AND PREFERRED EMBODIMENTS THEREOF

Figure 1:
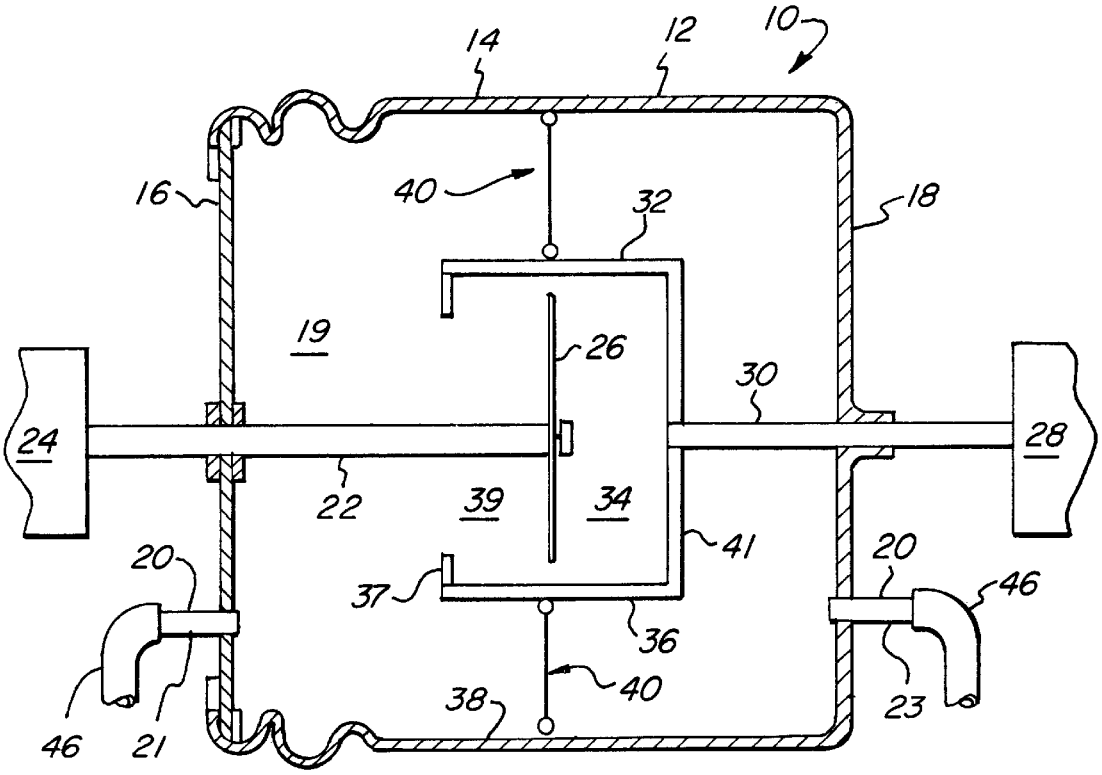
FIG. 1 is a longitudinal cross section of one embodiment of the present invention.
Figure 3:
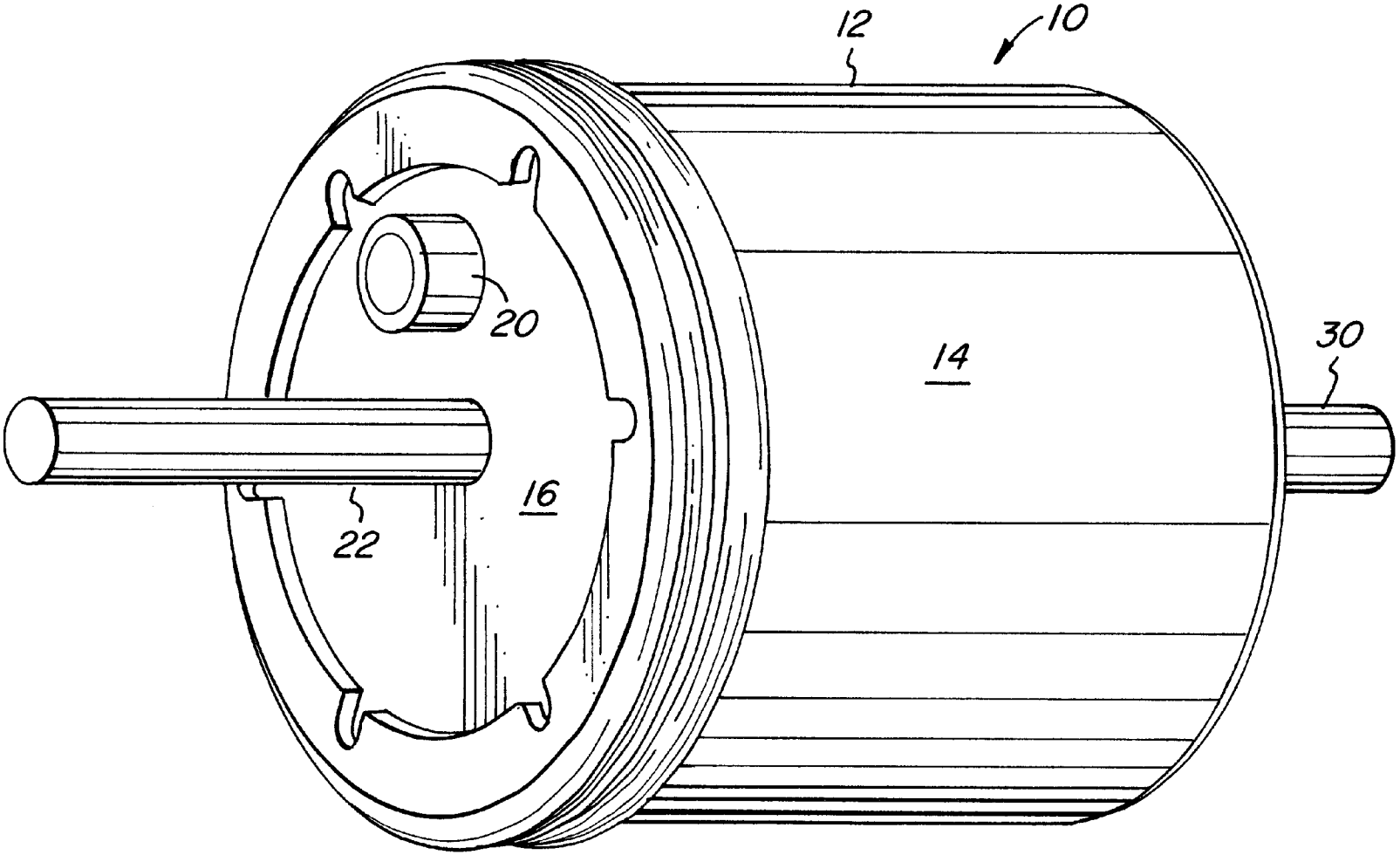
FIG. 3 is a perspective view of the embodiment of FIGS. 1 and 2.

Referring to FIG. 1, a moment pump 10 of the present invention comprises a container 12 having an outer wall 14 and two opposing end walls 16, 18 attached thereto which define an interior chamber 19. The container 12 is made of a resilient material, has a cylindrical shape, and has a preformed, non-biased shape as shown. A pair of one-way valves 20, being of conventional design, is operably attached to an input fluid connector and an output fluid connector 21, 23 in the container 12. Depending on the mounted position of the pump 10, the valves 20 would be mounted therein to address the fluid being pumped, whether a gas or a liquid. FIG. 3 is a perspective view of the moment pump 10. In FIG. 1, a first actuator rod 22 has fixedly attached on one end a first biasing object 24 and, on the other end, a restraining member 26. The first end wall 16 is fixedly attached to the first actuator rod 22 between the first biasing object 24 and the restraining member 26. A second actuator rod 30 has fixedly attached on one end a second biasing object 28 and on the other end a second end wall 41 of a transfer housing 32. The second actuator rod 30 slidably passes through the second end wall 18 of the flexible container 12 in a sealed manner.

The transfer housing 32 has an interior chamber 34 into which the longitudinal restraining member 26 of the first actuator rod 22 travels in confinement, not being able to leave the interior chamber 34. The interior chamber 34 prevents the restraining member 26 from being removed therefrom. The transfer housing 32 is cylindrically shaped about the interior chamber 34 and has an aperture 39 in the first end wall 37 of the transfer housing 32 into which the first actuator rod 22 enters.

Figure 2:
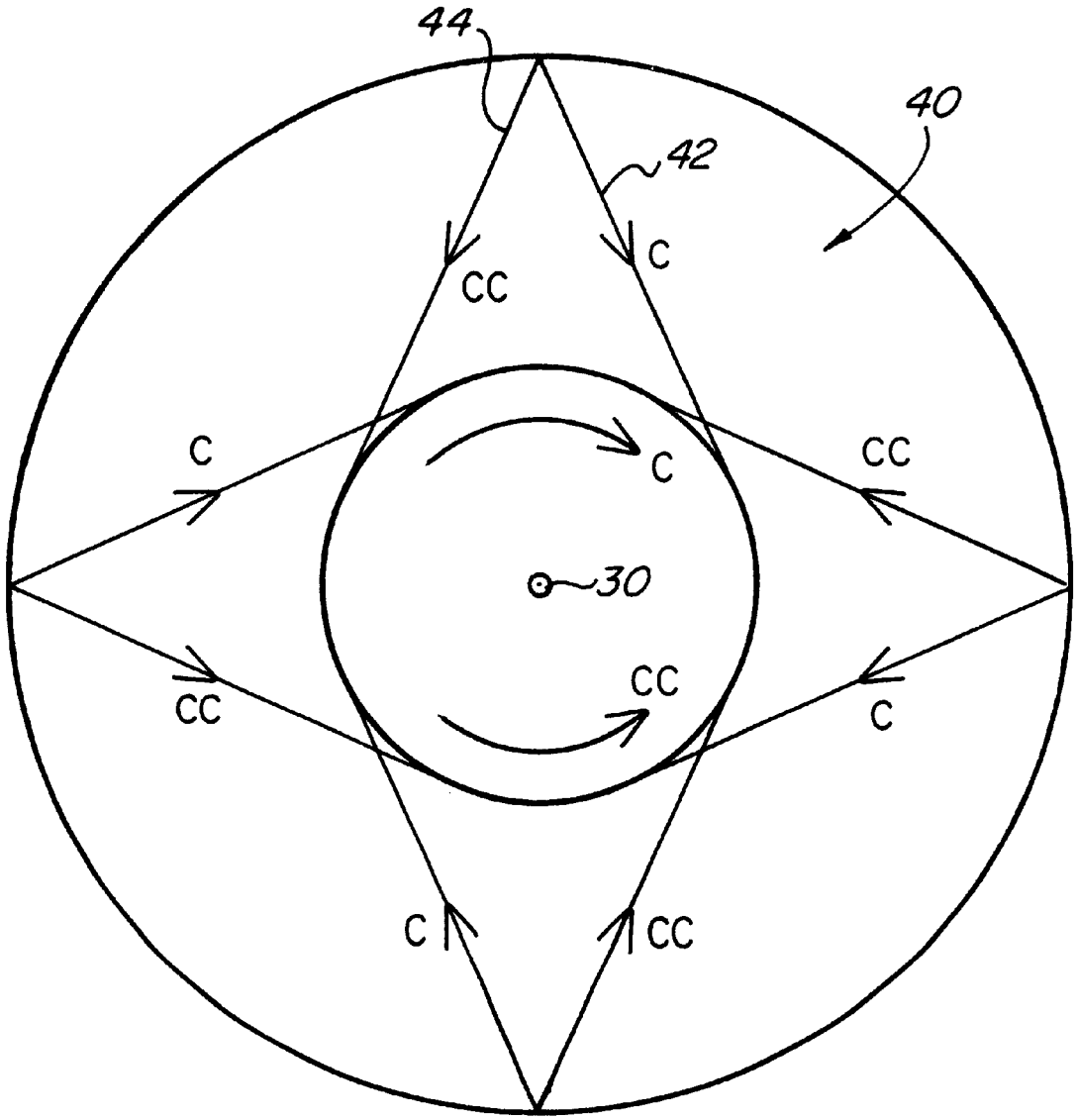
FIG. 2 is a transverse cross section of the embodiment as shown in FIG. 1.

Attached between the exterior wall 36 of the transfer housing 32 and the inner surface 38 of the outer wall 14 of the container 12 is a plurality of biasing tension actuators 40 divided into two sets of tension actuators, a clockwise set 42 and a counter-clockwise set 44 as seen in FIG. 2 which is a transverse cross section through the container 12. The tension actuators are mounted in a non-slack manner between the container 12 and the transfer housing 32. The clockwise set 42 is marked by a letter "c", and the counter-clockwise set 44 is marked by a letter "cc". The tension actuators in the clockwise set 42 are mounted at an angle less than 90 degrees to an angle greater than zero degrees. The counter-clockwise set 44 of tension actuators is mounted in a mirrored fashion to the clockwise set 42. The tension actuators are mounted uniformly about the transfer housing 32.

Movement of the transfer housing 32 by the second actuator rod 30 or movement of the container 12 by the first actuator rod 22, in any moment of energy which may be a translational, rotational or radial movement of at least one actuator rod, causes the outer wall 14 of the container 12 to be pulled in a direction to the transfer housing thus decreasing the volume therein. This acts as the pump action. Upon release of the biasing force, the outer wall of the container returns to its resilient shape and this action draws fluid into the container. A pair of hoses 46 is attached to the input and output fluid connectors 21, 23.

Although the first biasing object 24 and the second biasing object 28 are not further defined, the forces acting thereon may be man-made or natural and also may not be truly cyclic in nature such as ocean waves or tides.

While the invention has been described in detail with respect to specific preferred embodiments thereof, numerous modifications to these specific embodiments will occur to those skilled in the art upon a reading and understanding of the foregoing description; such modifications are embraced within the scope of the appended claims.

What is claimed is:

1. A moment pump dimensioned and configured so that an external biasing force will cause the moment pump to pump a fluid, the moment pump comprising:

a flexible container having an outer wall, a first end wall and an opposite end wall, the walls cooperating to form an interior chamber of the flexible container;

a transfer housing being positioned within the interior chamber of the flexible container, the transfer housing having an outer wall, a first end wall with an aperture therein and an opposite end wall, the transfer housing walls cooperating to form an interior restraining member chamber;

a first actuator rod being dimensioned and configured for connection to a first biasing object at one end thereof when in operation, the first actuator rod being fixedly connected to the first end wall of the container, and having a longitudinal restraining member on the other end being positioned within the interior restraining member chamber;

a second actuator rod being dimensioned and configured for connection to a second biasing object at one end thereof when in operation, the second actuator rod being slidably connected to the opposite end wall of the container, and being fixedly connected to the opposite end wall of the transfer housing;

a plurality of biasing tension actuators being connected to the transfer housing and the outer wall of the flexible container, whereby a biasing force applied to the actuator rods, either singly or together, cause the outer wall of the flexible container to contract in the direction of the transfer housing, whereby the interior chamber's volume decreases, upon release of the biasing force, the outer wall of the flexible container returns to its unbiased shaped;

an input fluid connector having a one-way valve operably connected to the input fluid connector, the input fluid connector attached to the flexible container; and an output fluid connector having a one-way valve operably connected to the output fluid connector, the output fluid connector attached to the flexible container, whereby the application and release of the biasing force causes the flexible container to pump fluid therethrough.

2. The moment pump of claim 1 wherein the plurality of biasing tension actuators comprises a first and a second set, the first set acting in a clockwise manner and the second set acting in a counter-clockwise manner.

* * * * *